US008587429B2

(12) United States Patent
Melvin, Jr. et al.

(10) Patent No.: US 8,587,429 B2
(45) Date of Patent: Nov. 19, 2013

(54) DEVICE AND METHOD FOR SWITCH-ISOLATED POWER CONTROL OF ONE OR MORE COMMUNICATION DEVICES

(75) Inventors: Charles W. Melvin, Jr., Dudley, GA (US); Robert Bryan Seal, Meridian, MS (US); William M. Dilback, Madison, MS (US)

(73) Assignee: Itron, Inc., Liberty Lake, WA (US)

( * ) Notice: Subject to any disclaimer, the term of this patent is extended or adjusted under 35 U.S.C. 154(b) by 438 days.

(21) Appl. No.: 12/899,480

(22) Filed: Oct. 6, 2010

(65) Prior Publication Data

US 2012/0050040 A1 Mar. 1, 2012

Related U.S. Application Data

(60) Provisional application No. 61/376,999, filed on Aug. 25, 2010.

(51) Int. Cl.
*G08B 13/08* (2006.01)

(52) U.S. Cl.
USPC ..... 340/545.6; 340/870.02; 726/34

(58) Field of Classification Search
USPC ..... 340/870.02, 870.03, 545.6, 541, 568.1; 726/22, 23, 26, 34; 361/679, 683, 686, 361/724, 728, 736, 737, 748, 752, 784, 796, 361/798
See application file for complete search history.

(56) References Cited

U.S. PATENT DOCUMENTS

| | | | | |
|---|---|---|---|---|
| 4,454,552 | A | 6/1984 | Barnes et al. | |
| 5,077,675 | A | 12/1991 | Tam | |
| 5,638,289 | A | 6/1997 | Yamada et al. | |
| 6,232,676 | B1 | 5/2001 | Kozyra et al. | |
| 6,816,936 | B1 | 11/2004 | Wu et al. | |
| 7,016,202 | B2 | 3/2006 | Shih | |
| 7,026,932 | B2 * | 4/2006 | Loudon | 340/568.1 |
| 7,432,823 | B2 * | 10/2008 | Soni | 340/870.02 |
| 2005/0039040 | A1 * | 2/2005 | Ransom et al. | 713/200 |
| 2008/0134349 | A1 * | 6/2008 | Fleischman et al. | 726/34 |
| 2011/0193701 | A1 * | 8/2011 | Hanft | 340/568.1 |

OTHER PUBLICATIONS

Cisco, Online Insertion Removal and Hot-Swapping, http://www.aironet.info/en/US/docs/routers/access/2900/hardware/installation/guide/appendix.pdf.

* cited by examiner

*Primary Examiner* — Thomas Mullen
(74) *Attorney, Agent, or Firm* — Hanley, Flight & Zimmerman, LLC.

(57) ABSTRACT

In one or more embodiments, an intelligent communications device is disclosed. In one embodiment, a plurality of circuit boards are operative to perform communication functions in a network, where the device includes a first circuit board and a second circuit board. The device includes a first actuatable member that is operative to selectively activate circuitry on the second circuit board, where the first actuatable member has a toggle switch that is operative to disable power supplied to the second circuit board while the first circuit board retains power and is fully operative to perform communications functions. The device includes a second actuatable member that is operatively coupled to an enclosure and a detachable cover. The detachable cover is configured to raise an alert when an unauthorized entity attempts to access the circuitry.

29 Claims, 11 Drawing Sheets

DEVICE AND METHOD FOR SWITCH-ISOLATED POWER CONTROL OF ONE OR MORE COMMUNICATION DEVICES

CROSS REFERENCE TO RELATED PATENT APPLICATION

This application claims the benefit, pursuant to 35 U.S.C. §119(e) of U.S. provisional Application Ser. No. 61/376,999, filed Aug. 25, 2010, entitled "Device and Method for Switch-Isolated Power Control of One or More Communication Devices" by Charles W. Melvin, Robert B. Seal, and William M. Dilback, the disclosure for which is hereby incorporated by reference in its entirety.

FIELD OF THE INVENTION

The present application relates generally to network routers, and more specifically to an intelligent communications device for a smart grid, hereinafter also referred to as an "apparatus" or "network apparatus", for managing interconnection of various electrical devices and facilities.

More particularly, according to one or more aspects, the present application relates to switch-isolated power control of circuitry in an intelligent communications device.

SUMMARY OF THE INVENTION

In one aspect, the present invention relates to a system and method for controlling operation of a plurality of electronic devices in a smart grid. In one or more exemplary embodiments, an intelligent communications device is operatively connected with other devices and/or systems and one or more electrical distribution networks. One or more of these electronic devices may work in collaboration with the intelligent communications device in a smart grid network infrastructure. In one or more embodiments, the electronic devices may be arranged in various configurations to operate in networks such as LAN, WAN, and/or HAN networks.

In one embodiment, the intelligent communications device is configured with other devices and/or monitoring equipment for monitoring and management of electrical energy consumption. The intelligent communications device operates on wireless communications networks and according to one or more wireless protocols such as commercial cellular, Bluetooth, and/or 802.11.

In one embodiment, the intelligent communication device is field upgradable, and is configured such that additional hardware can be installed for enabling new protocols or technologies to be developed. The intelligent communications device is operative to implement open source software configured to facilitate integration of different types of devices with additional circuitry and/or hardware. Further, the intelligent communications device is operable to update the open source software periodically or at a pre-defined time.

Embodiments of the present invention provide one or more actuatable members for activating/deactivating a power supply to at least one of the plurality of circuit boards and for detecting a security breach in an intelligent communication device operating in a smart grid. The intelligent communication device may include a power supply circuit board and a plurality of other circuit board. A first actuatable member may disable power to at least one of the plurality of circuit boards while maintaining power supply to at least one of the plurality of other circuit boards. In this aspect, the intelligent communication device may be fully operative; the operations corresponding to one of the plurality of circuit boards isolated by enabling the first actuatable means to remain suspended. The plurality of other circuit boards is enclosed in a utility grade enclosure hinged to a detachable cover. A second actuatable member associated with the detachable cover is associated with detachable cover, which may sound an alert, when an unauthorized person removes a detachable cover.

DETAILED DESCRIPTION OF THE INVENTION

Description of the various embodiments detailed below is for understanding the invention. It will be understood that the invention is not limited to the particular embodiments described herein, but is capable of various modifications, rearrangements and substitutions, which will now become apparent to those skilled in the art without departing from the scope of the invention. Therefore, it is intended that the following claims cover all such modifications and changes that fall within the spirit and scope of the invention.

In alternative embodiments, system, process, and apparatus may include additional, fewer, or different components. In addition, the each component may include additional modules, software, and interface devices that may be appended on requirement to operate the present invention in alternate embodiments.

Figure 1:
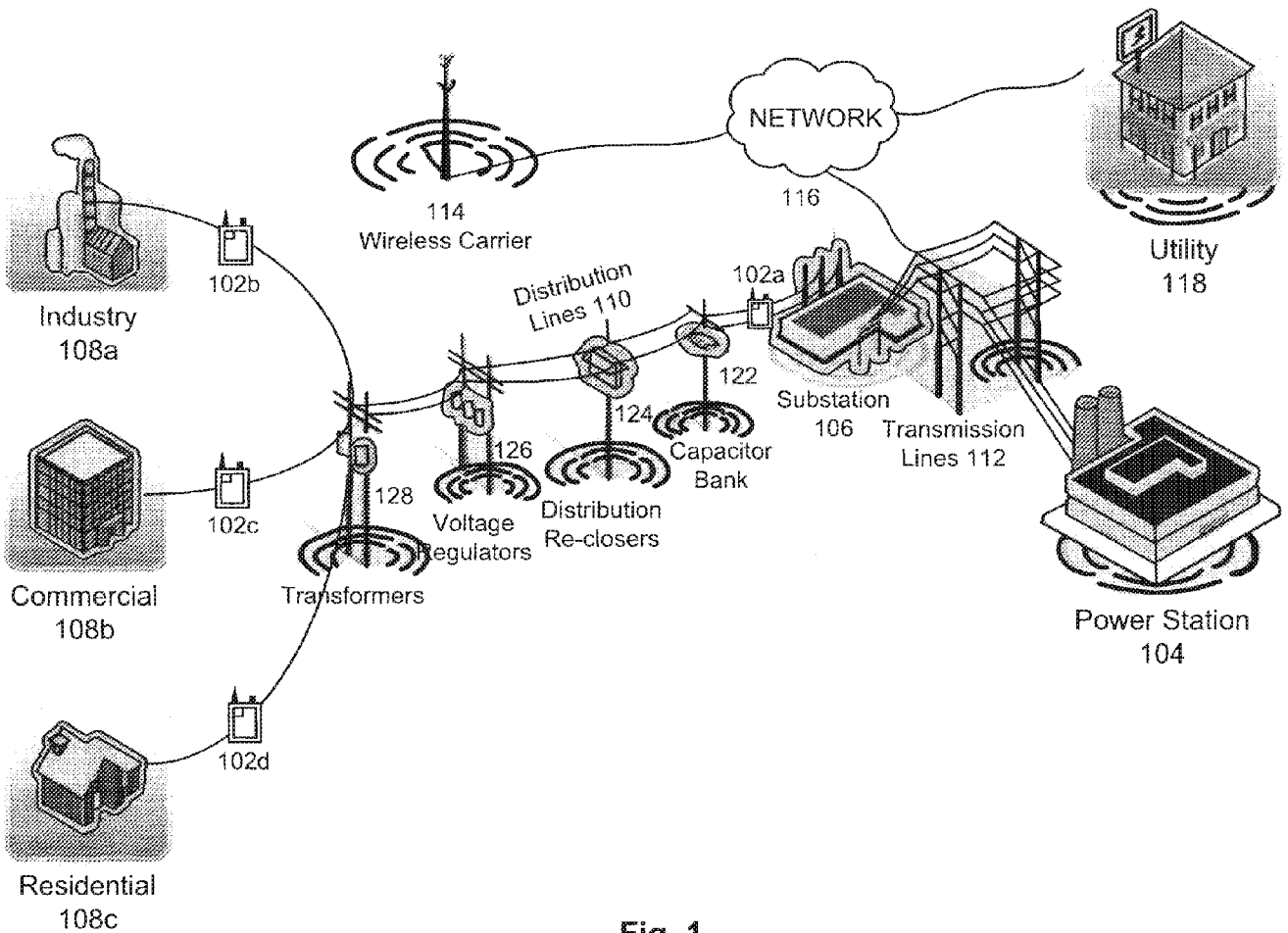
FIG. 1 is a schematic illustration of an overall environment in which one or more aspects of the present invention can be practiced.

Referring to FIG. 1, an intelligent communications device for a smart grid communicatively coupled to a plurality of devices and/or facilities for management of energy requirements is depicted. Integration of the intelligent communications device 102 into the smart grid infrastructure may be performed using minimal capital expenditure.

FIG. 1 illustrates an environment in which the present invention may be practiced. The environment may include a plurality of electrical generation facilities such as thermal power plants, hydro-based power plants (dams, for example), solar powered electricity generation units, and wind powered electricity generation units. Various electricity-generating plants are collectively referred to as a power station 104. The electricity generated from the power station 104 may be distributed through a plurality of high voltage transmission lines 112 to a substation 106. For example, high voltage electricity may be distributed via a plurality of towers and a plurality of medium voltage distribution cables 110.

By way of example and not as a limitation in an implementation, the substation 106 may receive power via the plurality of high voltage transmission lines 112 from at least one of the power stations 104. Further, the substation 106 may be associated with an intelligent communications device 102. The intelligent communications device 102 may monitor various parameters such as electricity quality and electrical load.

The substation 106 may then distribute low voltage electricity to residential entities 108 *c*, industrial entities 108 *a*, commercial entities 108*b*, and/or residential entities 108 *c*. The medium voltage distribution lines 110 may include attachments of various devices for the improvement of electricity quality. As such, the plurality of distribution lines 110 may run moderate distances and may be affected by cable resistance, electrical grid loading, and other factors which may constantly affect the operation and efficiency of the electric grid. In order to compensate for a variety of operating conditions, the plurality of distribution lines 110 may include connections to capacitor banks 122, distribution reclosers 124, voltage regulators 126, transformers 128 and other types of equipment.

The electricity may be supplied to the one or more industrial entities such as industry 108 *a* via intelligent communications device 102 *b*. Likewise, the plurality of distribution lines 110 may feed electricity to one or more commercial entities 108 *b*, and/or one or more residential entities 108 *c*, through intelligent communications devices 102 *c* and 102 *d*. Hereinafter, intelligent communications devices 102 *a*, 102 *b*, 102 *c*, and 102 *d* may be collectively referred to as "intelligent communications device 102."

The intelligent communications device 102 may be configured to operate with a central control station, regulatory authority, audit compliance authority, and/or electrical monitoring systems. Apart from monitoring the various parameters such as electrical quality, the intelligent communications device 102 may be coupled wirelessly to a plurality of wireless carriers 114. Alternatively, the intelligent communications device 102 may be coupled with communications network 116 using powerline communication. Further, the wireless carrier 114 may receive signals that may be utilized for moderating the distribution of electricity from the substation 106 to industrial entity 108 *a*, commercial entity 108 *b*, and/or residential entity 108 *c*.

The intelligent communications device 102 may be connected with a plurality of utilities in a building, a commercial complex, and/or an industry. By way of example and not a limitation, in one implementation, intelligent communications device 102 may be connected to utility 118. In an embodiment, the utility 118 may include lighting systems, refrigerators, air conditioners, computers, televisions, home theaters, electric irons, water filters, air filters, air compressors, and/or vacuum cleaners. The intelligent communications device 102 may directly control the utility 118. In another embodiment, one or more intelligent communications devices 102 may indirectly control the utility 118. In yet another embodiment, the utility 118 may be partially controlled by one or more intelligent communications devices 102 for moderating the electrical consumption. It may be noted that only one implementation is provided; however, those skilled in the art would appreciate that various other implementations are possible without deviating from the scope and spirit of the invention.

The utility may be grouped into essential and non-essential electrical equipment for purposes of control. In this embodiment, the intelligent communications device 102 may be programmed to monitor the one or more utilities 118 on a rule based program.

In an embodiment of the present invention, the intelligent communications device 102 may be coupled to multiple consumers such as industrial entities 108*a*, commercial entities 108*b*, and residential entities 108*c*. The consumer 108*a*, 108*b*, and 108*c* may be hereinafter collectively referred to as 'consumers 108'. The intelligent communications device 102 may facilitate management of electricity to one or more consumers 108. Additionally, the intelligent communications device 102 may also be integrated to communications backhaul providers that may work in synchronization for accumulating data related to electrical consumption, load distribution, quality of electricity, power factor, and/or failure of equipment associated with the distribution of electricity. The information may be communicated to control and monitoring station, either through the network 116 or through wireless carriers 114.

In an embodiment of the present invention, the consumers 108 may be distributed in a geographical area and may be connected to each other through a smart grid. In addition, each consumer 108 may have one or more smart appliances. The smart appliances may be managed by the intelligent communications device 102 for optimizing electricity consumption.

Figure 2:
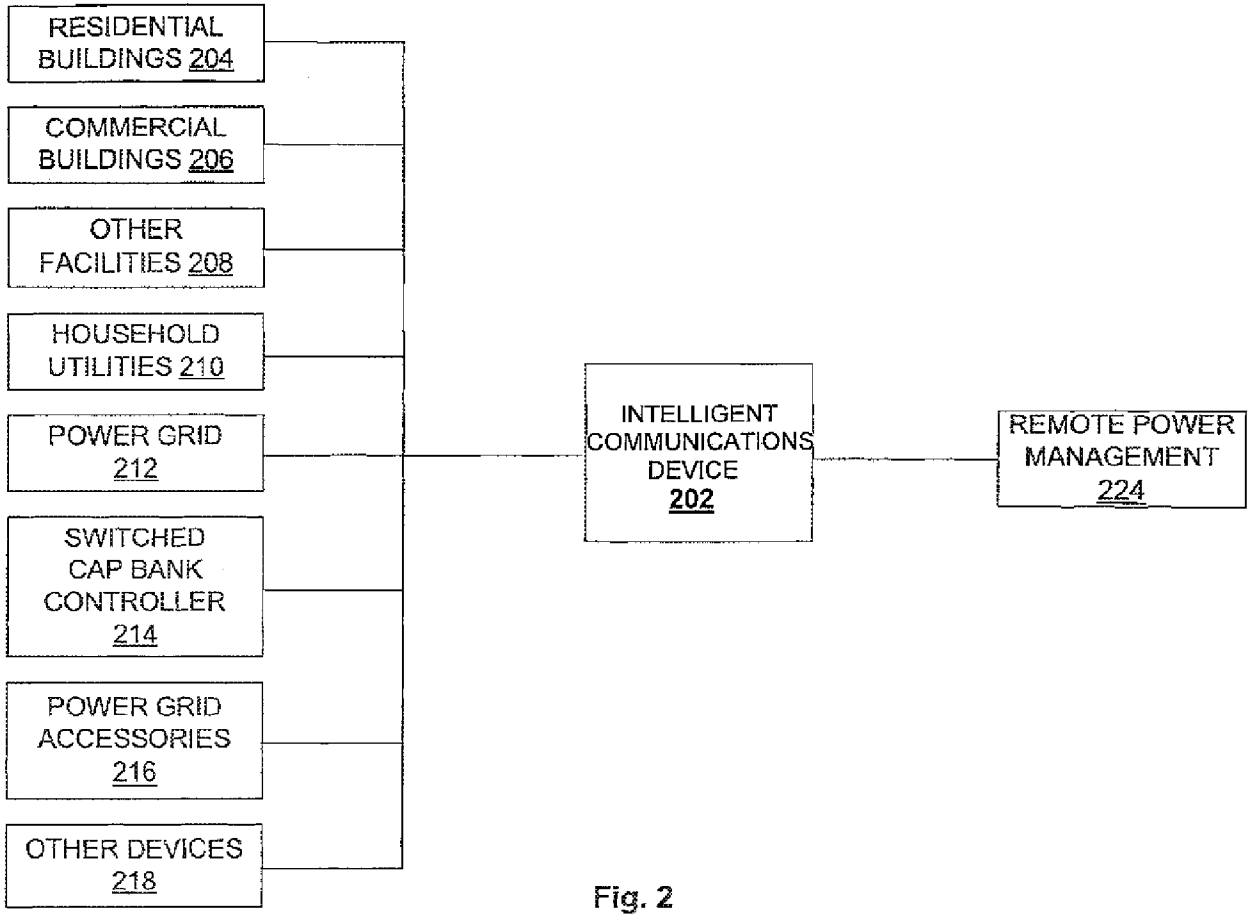
FIG. 2 depicts various facilities, devices and equipment interfaced with an intelligent communications device according with one embodiment of the present invention.

Referring to FIG. 2 an arrangement of configuring various electrical facilities with an intelligent communications device 202 is shown, according to one embodiment of the present invention. The intelligent communications device 202 may communicate with the plurality of devices and/or facilities, such as but not limited to, residential buildings 204, commercial entities 206, other facilities 208, household utilities 210, power grids 212, switched cap bank controllers 214, grid accessories 216, other devices 218, and remote power management utilities 224. Other facilities 208 may include but are not limited to schools, small offices, sports complexes, shops, malls, federal offices, utility complexes, or other types of buildings having electrical connections and consuming electricity. The intelligent communications device 202 may facilitate energy management for one or more of the devices and/or facilities as shown.

Power Management

In an embodiment of the present invention, the intelligent communications device 102 may enable distribution companies to reduce the overall power requirement through better management. This in turn may help in reducing the need for power generation thereby reducing environmental damage. Further, the intelligent communications device 102 may act as a communications hub for monitoring electrical usage, power consumption, quality of electricity, and/or analysis of electrical load, where examples of load type may include inductive load and/or capacitive load. The communications hub may interface with various devices in order to monitor electricity consumption and/or power usage.

The intelligent communications device 102 may enable integration of various utilities with the grid for optimizing the overall performance of the system. For example, the load requirement of a particular building may be assessed/monitored using the intelligent communications device 102. The data collected by the intelligent communications device 102 from the various utilities may be utilized for improving the overall electrical consumption of these utilities thereby saving cost and electricity. Alternatively, the intelligent communications device 102 may monitor the performance of different electrical utilities and may facilitate their management in an optimized way.

In another embodiment, the intelligent communications device 102 may be utilized by distribution companies for monitoring the quality of electricity and load characteristics for a specific area. The data recorded by the intelligent communications device 102 may be utilized for increasing the operational efficiency of the power grid.

In another embodiment, the intelligent communications device 102 may facilitate management of demand response for a grid. Currently, power generation and/or power distribution companies face pressure to reduce load either electronically or manually. In such settings, transmission grid operators use demand response to request load reduction in order to manage demand. One or more aspects of the present invention according to this exemplary embodiment allow for transmission grid operators to utilize the intelligent communications device 102 for electronically managing the demand response of electricity.

Integration with Power Grid

In one embodiment, the intelligent communications device 102 may include a communication module for connecting it with a smart grid. In this aspect, the intelligent communications device 102 may increase the performance of the smart grid making it more adaptable and cost effective. In addition, the intelligent communications device 102 may enable utilities to interface with the grid irrespective of the underlying technology, network, or assets. The intelligent communications device 102 may be flexible to accommodate any configuration changes and/or bandwidth changes without affecting the underlying architecture/technology.

In another embodiment of the present invention, the intelligent communications device 102 may communicate with other apparatuses. The communication may be either wireless or through a wired connection. Such communication may occur in response to a critical event such as a power surge, excess demand, or a low power factor, when immediate action is required for safeguarding the electrical equipment associated with the transmission infrastructure. In another embodiment, the communication between different apparatuses may occur on a continuous basis for optimizing the performance of the system.

Field Upgradability

In another aspect of the present invention, the intelligent communications device 102 may be field-upgradeable and may provide field replaceable units for preventing obsolescence. The intelligent communications device 102 may allow utilities to add multiple communication technologies to the smart grid communication infrastructure with change of the underlying technology. By integrating multiple communication technologies, the intelligent communications device 102 may act as a universal hub, to reduce the cost of purchasing additional equipment for implementing multiple network communications protocols. Consumers 108 may integrate multiple appliances and multiple communication technologies using intelligent communications device 102 thereby reducing the total cost of ownership of the equipment. Additionally, consumers 108 may upgrade the intelligent communications device 102 to integrate new communication protocols by just installing additional circuitry without changing existing equipment.

The intelligent communications device 102 may further include a software update module that may connect to the Internet for availability of firmware updates. In response to availability of firmware updates, the software update module may back-up the current firmware before upgrading the intelligent communications device 102 with the new firmware. Failure to implement the new firmware may result in reinstallation of the old firmware from the back up.

In another embodiment of the present invention, the intelligent communications device 102 may include additional slots for inserting PCB boards. These PCB boards may include circuitry for enabling specific protocol, for example, one PCB board may implement EDGE protocol. Similarly, in another example, a PCB board may implement WiMax protocol. Field service personnel may insert additional PCB boards for upgrading the existing communication protocol without having to replace the intelligent communications device 102. Thus, the intelligent communications device 102 may be upgraded while in operation.

In another embodiment of the present invention, the intelligent communications device for a smart grid may include PCB boards supporting various communication technologies such as but not limited to, WiMax, EDGE, IPv4/IPv6, Bluetooth, Infrared, broadband over powerline, and Ethernet. Software configured in the intelligent communications device 102 may be utilized to enable/disable one or more communication boards. Thus, in one implementation, the apparatus may support Ethernet. In another implementation, the intelligent communications device 102 may support Ethernet and Bluetooth. In these scenarios, the field service personnel may update the intelligent communications device 102 by enabling the boards supporting various communication technologies remotely.

In yet another embodiment of the present invention, the intelligent communications device 102 may include utility circuitry for upgrading it on site. Further, the intelligent communications device 102 may include software and/or modules for adding multiple communication technologies to the smart grid communications infrastructure based on future needs without having to replace an entire system backbone. By virtue of having capabilities for adding new devices and facilities, the intelligent communications device 102 may allow consumers to purchase and integrate non-interoperable proprietary technologies from multiple vendors. Vendors may integrate heterogeneous devices using intelligent communications device 102 thereby creating an open environment. In this aspect, the intelligent communications device 102 may allow for consumers to avoid being committed to a specific vendor.

Consumption Monitoring

Consumers of electricity may save money by planning their energy requirements in areas implementing Time-Of-Use (TOU) pricing. Consumers may plan the use of electrical appliances during off-peak hours, when the cost of electricity is less, for reducing the total cost of electricity consumption. The intelligent communications device 102 may facilitate the reduction in total consumption of electricity by automatically switching on the electrical appliances during non-peak hours.

Network Protocol Implementation

The intelligent communications device 102 may be based on Internet Protocol (IP) thereby providing seamless integration with different types of networks. For example, the intelligent communications device 102 may facilitate communication with both public and private networks. In embodiments, the network may be either a wired network or a wireless network. Further, networks classified on the basis of scale, such as LAN, WAN, HAN, or functional relationships, such as client-server, peer-to-peer, active networks, and/or overlay networks are included within the scope of the invention. In an exemplary embodiment, the intelligent communications device 102 communicates using TCP/IP. Likewise, the intelligent communications device 102 may interface with other devices implementing conventional protocols.

The intelligent communications device 102 may facilitate smart grid-enabled appliances to communicate wirelessly with electrical distribution companies to manage their overall consumption of electricity. For example, the intelligent communications device 102 may manage consumption of electricity during peak hours for a distribution network. In this aspect, the intelligent communications device 102 may communicate in real-time with various facilities and other devices to optimize energy efficiency.

In an embodiment of the present invention, the intelligent communications device 102 may include an Ethernet interface for connecting it with an external network such as a LAN, WAN, or HAN. Further, the Ethernet interface may enable communication with the Internet thereby facilitating remote management of utilities. The intelligent communications device 102 may record various parameters such as electricity consumption and/or power usage, and may transfer the recorded data to the remote infrastructure management facility for optimization of the electrical consumption. To this end, the intelligent communications device 102 may enable optimum utilization of the grid infrastructure. The intelligent communications device 102 may be built for outdoor use and may be protected from environmental hazards.

The intelligent communications device 102 may be capable of interfacing with various protocols, networking standards, and other specifications. In an example, the intelligent communications device 102 may facilitate communication by implementing WiMax protocol. In another example, the intelligent communications device 102 may communicate using Bluetooth protocol. In embodiments, the intelligent communications device 102 may communicate using other protocols such as but not limited to token ring, EDGE, UDP, datagram and other proprietary Internet communications protocols. In an example, the intelligent communications device 102 may facilitate communication with ZigBee protocol that allows devices in the home to communicate with a smart meter and neighborhood hub.

In an embodiment of the present invention, the electrical distribution companies may analyze the electrical consumption data collected over a specified period for better management of energy. The intelligent communications device 102 may include a communication link with a database for storing electrical consumption data. In an embodiment, the specified period may be an hour, a day, a month, a year, or any combination of these.

The intelligent communications device 102 may facilitate interoperability among smart grid devices, thereby facilitating seamless deployment of smart devices in a smart grid. In this aspect, various smart devices including smart appliances and smart meters may work in harmony with the intelligent communications device 102. Thus, the intelligent communications device 102 may integrate into the existing smart grid deployment without competing with other existing devices. Alternatively, it may enhance the capability of other smart devices. In an embodiment of the invention, the intelligent communications device 102 may allow integration with other devices without the need for installing additional devices and/or interface circuitry. The smart devices can be configured with the intelligent communications device 102 for management of smart appliances for increasing the operational efficiency of the smart grid. Smart appliances refer to the class of products that enable communication with smart meters and neighborhood hubs for saving energy.

The intelligent communications device 102 may enable Internet Protocol based communication involving end-to-end connectivity on a public wireless network. The intelligent communications device 102 may further facilitate two-way delivery of real-time energy usage data over a public wireless network. In an embodiment, the real-time data may include location information along with energy usage information.

In an embodiment of the present invention, the intelligent communications device 102 may include one or more communication ports for connecting to different types of communication devices. The intelligent communications device 102 may include switches, hubs or other interface circuitry for coupling with the external devices. Additionally, the intelligent communications device 102 may include a wireless communication module for connecting with wireless appliances and/or smart devices. In this aspect, the wireless devices such as smart appliances may be enabled by low power protocol such as 6 LOWPAN. Alternatively, the wireless devices may be enabled using Bluetooth, EDGE, IEEE 802.11, and/or infrared.

Open Standards Implementation

The intelligent communications device 102 may implement open standards to leverage existing programs and tools. In this aspect, the intelligent communications device 102 may facilitate rapid application deployment and delivery of the new functionality. For example, the intelligent communications device 102 may update the applications and/or programs in real time. Additionally, updates corresponding to programs and/or applications may be executed at a predefined time in order to update the software, drivers, interface ports, and/or applications. This may ensure that the intelligent communications device 102 may be fully equipped to deny any security attack on it. In another example, interfacing a new smart device with the intelligent communications device 102 may initiate a search for software. Failure to discover appropriate software may result in searching for the required software at a remote location such as the Internet. Thus, the intelligent communications device 102 may perform self-healing by automatically scanning and integrating new devices and/or facilities in the smart grid infrastructure.

Enclosure

Figure 3A:
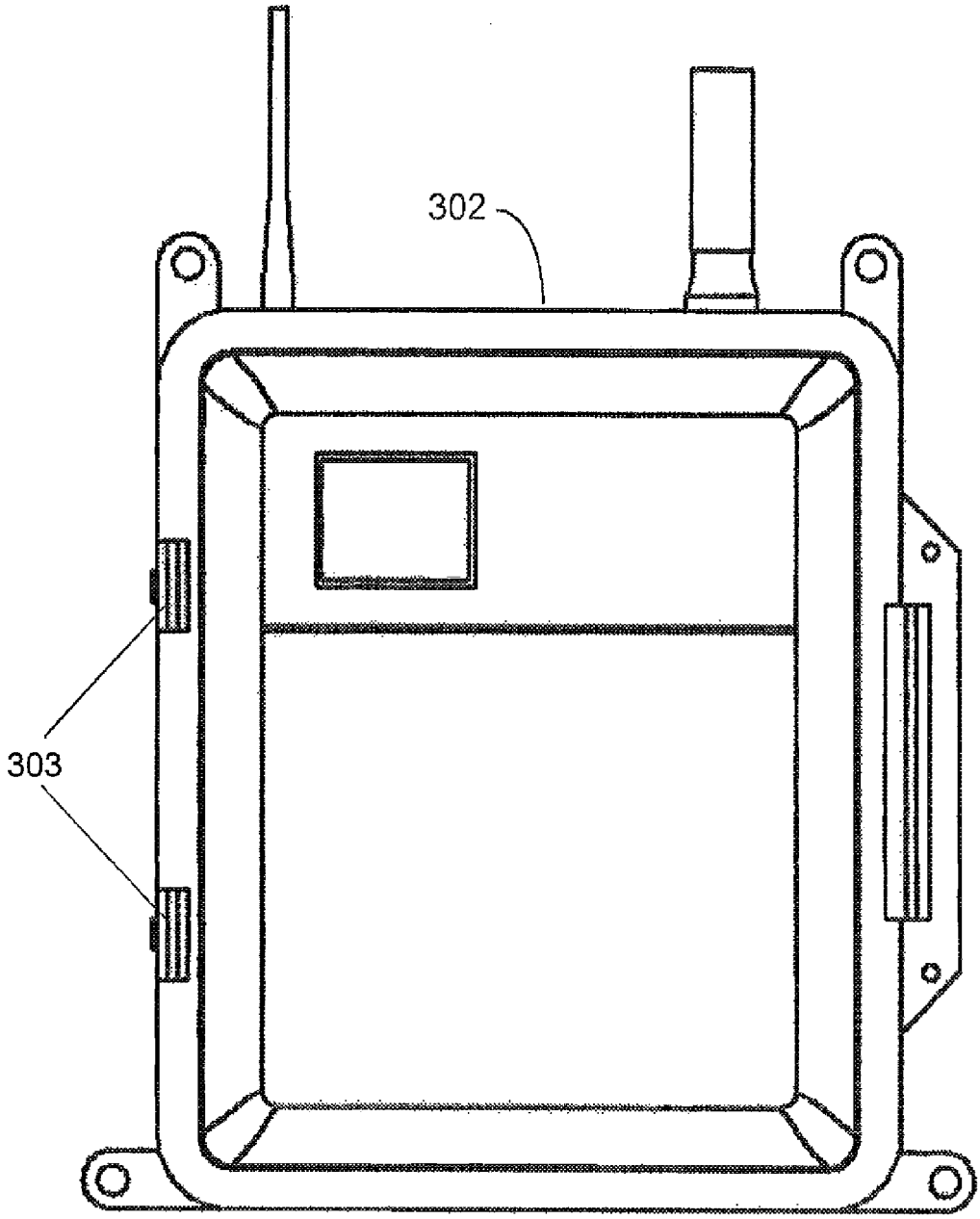
FIG. 3 depicts various modules associated with an intelligent communications device according to one embodiment of the present invention.

Referring to FIG. 3A, an outer enclosure 302 (detachable and hinged on hinges 303) associated with the intelligent communications device 102 is shown, according to one embodiment of the present invention. The intelligent communications device 102 may be enclosed in the enclosure 302, which may be suitable for rapid deployment. In this embodiment, the modular and compact design of the intelligent communications device 102 may protect it from damage during installation. The modular design may further enable rapid installation of intelligent communications device 102. For example, the compact modular design may facilitate installation of the intelligent communications device 102 within a small space.

In embodiments, the enclosure may be fabricated from metal, plastic, and other materials, which may be combined.

The compact modular design of the enclosure may be modified for installation in hazardous areas such as refineries, gas plants, and CNG stations. Special enclosures may be provided for installing the intelligent communications device 102 in hazardous areas. In an embodiment of the present invention, the casings and/or enclosures may facilitate a long operational lifetime of the intelligent communications device 102.

Figure 3B:
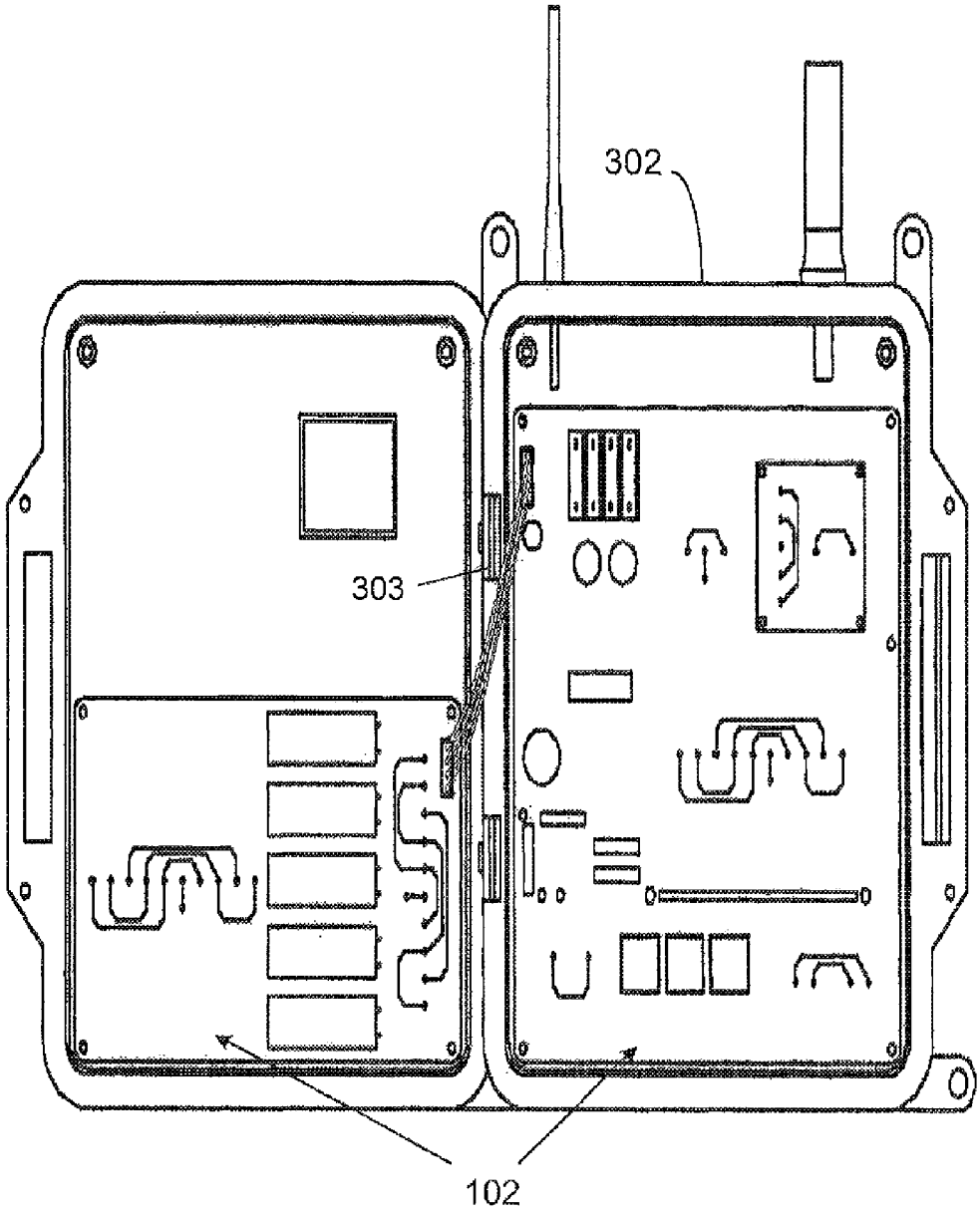

FIG. 3B depicts various circuit boards of the intelligent communications device 102 embedded in the enclosure 302 for safety. The enclosure may include circuitry 306, 308 to raise an alarm if the enclosure is tampered with by an unauthorized entity. Additionally, a provision may be provided in the apparatus that may intelligently determine if the enclosure is opened for repair through an authorized entity.

Management Tools

The intelligent communications device 102 may be interfaced with standard off-the-shelf network management tools. In an embodiment of the present invention, the management tools may be integrated in one or more utilities. Alternatively, the management tools may be implemented on computing devices such as personal computers, servers, and/or electrical control panels.

The intelligent communications device 102 may work in harmony with other smart devices in order to create a seamless infrastructure and to enhance the capability of the smart grid infrastructure. Thus, the intelligent communications device 102 may allow reclosers from one vendor to be integrated with the electronic meters from another vendor for building a collaborative smart grid infrastructure.

The intelligent communications device 102 may implement open source and may facilitate two-way delivery of real-time energy usage data over public wireless network. Further, the open source may simplify deployment of the smart devices in a smart grid infrastructure.

Security Features

In an embodiment of the present invention, the intelligent communications device 102 may secure communication between the intelligent communications device 102 and the external smart devices. For this purpose, the intelligent communications device 102 may implement various security algorithms as known in the art, including IP security and cryptography for secure transfer of data. Internet Protocol Security (IPsec) is a protocol suite for securing Internet Protocol (IP) communications by authenticating and encrypting each IP packet of a data stream. In another embodiment, the intelligent communications device 102 may implement RSA algorithm for securing data transfer.

In embodiments, the intelligent communications device 102 may facilitate collaboration between various interconnected equipment in the smart grid infrastructure. For example, the intelligent communications device 102 may facilitate collaboration between groups of consumers. In another example, the intelligent communications device 102 may facilitate collaboration between different electrical appliances belonging to a particular consumer. In yet another example, the intelligent communications device 102 may facilitate optimization and collaboration of electricity usage related to a particular electrical appliance, for example, a consumer washing machine.

The transmission aspect may be focused on surveillance, fault management, and/or voltage regulation, among others. The intelligent communications device 102 includes software and/or applications for monitoring and surveillance, fault management, and/or voltage regulation. Reports of unusual activity detected by the intelligent communications device 102 may be forwarded to a control station or to security staff via an alert. The recorded data may be recorded in a log file, which may be forwarded to the concerned authority in real-time for remedial action. Alternatively, the intelligent communications device 102 may, based on its own capability, resolve the issue without raising an alert.

The distribution aspect may include among other aspects monitoring and management of switches, meters, and/or reclosers. The intelligent communications device 102 may allow integration of various devices into seamless smart grid configuration. For example, a meter from one vendor may be configured with the recloser from another vendor. By implementing open standards in the intelligent communications device 102, the distribution companies can focus on building the smart grid infrastructure without worrying about the product working on a dedicated technology, since the intelligent communications device 102 may act as a universal hub for integrating various technologies.

A consumer may utilize the intelligent communications device 102 for conserving electrical consumption. In this aspect, consumer devices may be directly connected with the intelligent communications device 102. Exemplary consumer devices may include transformers, fault management devices, power meters, water meters, gas meters, load limiters, and disconnect switches. The intelligent communications device 102 may manage these smart devices in an optimum manner for saving electricity.

Solar Power

In an embodiment of the present invention, the intelligent communications device 102 may be solar powered. The outer enclosure of the intelligent communications device 102 may be fitted with photovoltaic cells that may receive solar energy. The solar energy may be utilized to charge one or more batteries; the charged batteries may allow communication with utility management infrastructure even during a power failure. Thus, the apparatus may work continuously without interruption.

Solar power may be further utilized to provide power for critical activities during a power failure, such as clock, wireless facility, memory and other communication circuitry.

Computer-Executable Software Embodiments

In an embodiment of the present invention, the intelligent communications device 102 may include software and hardware for implementing virtualization. For example, the intelligent communications device 102 may implement hardware virtualization. Implementing virtualization may facilitate the process of disaster recovery, induce higher levels of abstraction, and increased levels of security.

In yet another embodiment of the present invention, the intelligent communications device 102 may include software for implementing distributed computing architecture. For example, various software processes may communicate with databases/repositories of the central control station to periodically update the repositories and/or databases. Such an arrangement may reduce the probability of loss of data during disaster and/or failure of other equipment.

In yet another embodiment of the present invention, the software-implemented multiple processes enable processing of data in real time. In this aspect, the software executed by the associated processor may spawn multiple threads for faster execution and real-time monitoring of the utilities. Such implementation may facilitate quick response to adverse events, thereby reducing the probability of failure of the overall infrastructure.

Figure 3C:
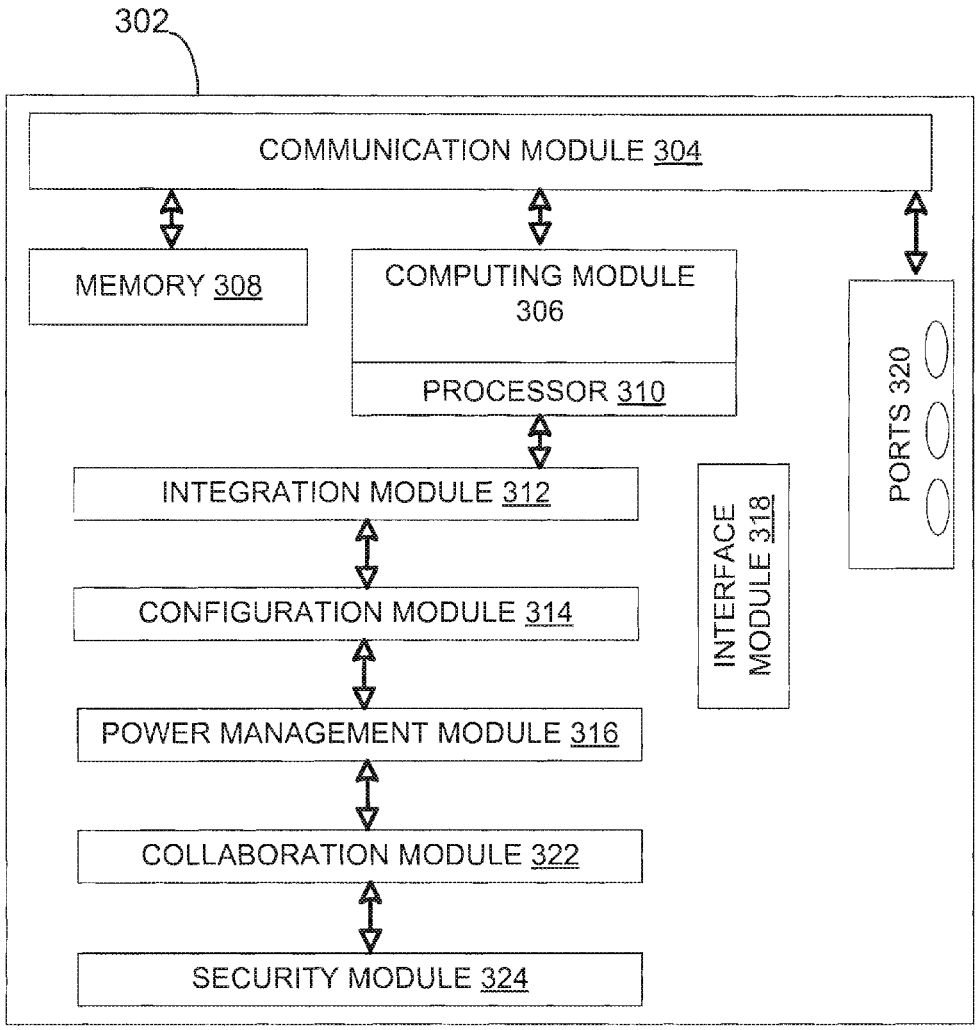

Referring to FIG. 3C, the intelligent communications device 102 may include an enclosure 302, a communication module 304, a memory 308, and a computing module 306 having a processor 310. The communication module 304 may be coupled with the memory 308 and to the computing module 306. In addition, the computing module 306 may be associated with the integration module 312 as well as interface module 318. The smart devices and/or facilities may be attached at one or more ports 320. The data received at one or more ports 320 may be forwarded to an integration module 312, a configuration module 314, a power management module 316, and the collaboration module 322. Additionally, smart devices may be incorporated into the smart grid infrastructure using a collaboration module 322.

In an embodiment of the present invention, addition of a device at one of the ports 320 may initiate integration of the device into the smart grid infrastructure. The signal received from the device may be forwarded to the interface module 318 to determine the type of device, attributes, and other details for integration with the intelligent communications device 102. Once the parameters of the devices have been ascertained, the integration module 312 and the configuration module 314 may facilitate integration for incorporating the device into the smart grid infrastructure. For example, the configuration module 314 may search for device drivers, applications and other software that may enable smooth adaptation of the device into the smart grid infrastructure.

In an embodiment of the present invention, a security module 324 may secure communication between the external smart devices and/or various facilities. For example, the security module may use encryption techniques known in the art for protecting data. Likewise, different security protocols may be implemented by the security module 324 for protecting data.

Figure 4:
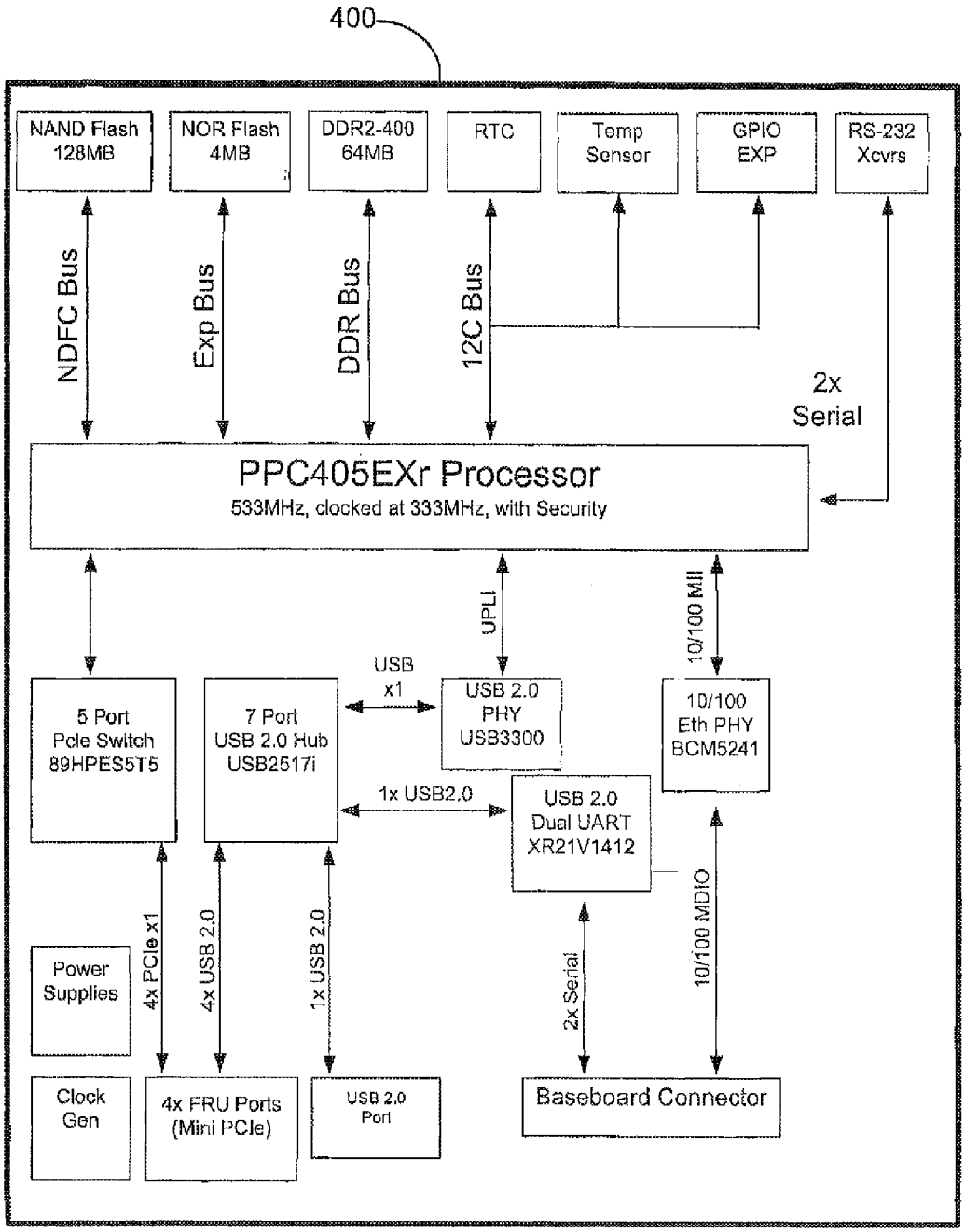
FIG. 4 schematically shows operative circuitry for an intelligent communications device according to one or more embodiments of the present invention.

Referring to FIG. 4, an exemplary outlay 400 of an intelligent communications device 102 is shown, according to one embodiment of the present invention. The internal configuration of the apparatus 400 may include a NAND flash, a NOR flash, a RAM, a temperature sensor, an RTC, a GPIO, and an interface circuitry such as RS232 coupled to the processor, such as a PPC405 EXr Processor. Additionally, a plurality of ports may be interfaced with the processor, such as USB ports, Ethernet ports, switch input connectors, and/or hubs. The circuitry may receive AC/DC power from the power supply, and the power supply may deliver different voltages such as +5V, −5V, +12V, −12V, +15V, −15V and other voltages. Various connectors may be utilized for connecting different type of active and passive components. A clock generation circuitry may be provided for servicing circuits requiring clock pulses.

In an embodiment of the present invention, integrated circuits may be utilized for assembling the embodiment shown in FIG. 4 in association with other active and passive electronic components. Additionally, the circuitry may be laid on a multilayer PCB for laying the passive and active electronic components and circuits.

Switch-Isolated Coupled Circuit Board

Figure 5:
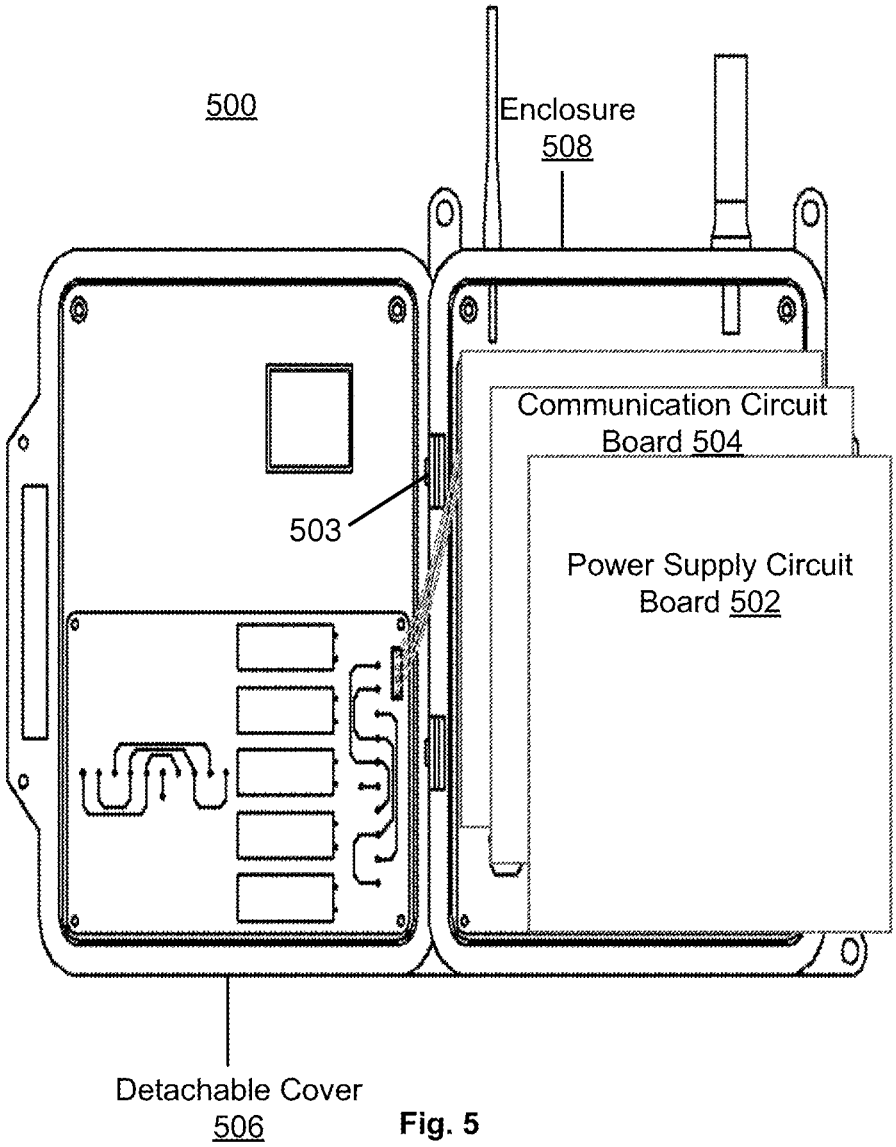
FIG. 5 depicts an enclosure comprising a plurality of circuit boards along with detachable cover in an embodiment of the present invention.

Now referring to FIG. 5, in one embodiment generally 500 of the present invention, the intelligent communications device 102 may include a plurality of circuit boards, for example, a power supply board 502, a communication board 504, and an I/O board (not shown). The plurality of circuit boards are enclosed in a utility grade enclosure 508 coupled to a detachable cover 506. Alternatively, the circuitry may be operatively installed within the enclosure of another communications or smart grid-related component. For instance, the circuitry may be installed in a larger utility-grade enclosure designed for circuit breaking in connection with power lines. Thus, the circuitry of the intelligent communication device 102 is not required to have its own dedicated enclosure, as long as the circuitry can be functionally provided and shielded within a sufficient surrounding to protect the circuitry from external elements and potential security breach by unauthorized entities. In one embodiment, the power supply circuit board 502 includes one or more voltage regulators for delivering regulated power supply and/or unregulated power supply. The regulated power supply may deliver fixed voltage to the digital circuits depending upon their respective operating voltages. For example, all of the digital circuits may be supplied with a voltage of +12V, −12V, +5V, and −5V, depending on particular requirements.

In one embodiment of the present invention, logical modules may be fabricated on different circuit boards. For example, a communication module may be fabricated on a separate circuit board hereinafter referred to as 'communication circuit board' 504. Power is supplied from the power supply circuit board 502 to the communication circuit board 504 through wires and connectors. It will be appreciated by those skilled in the art that the power supply circuit board 502 may include fewer or more components configured in an arrangement to deliver power to various circuit boards as known in the art. Additionally, multiple types of connectors and/or wires may be utilized to connect a power supply to the connectors such as a 20+4Pin xl, PCI-E connector, 4 Pin Molex connectors and/or a simple power supply connector.

Figure 6:
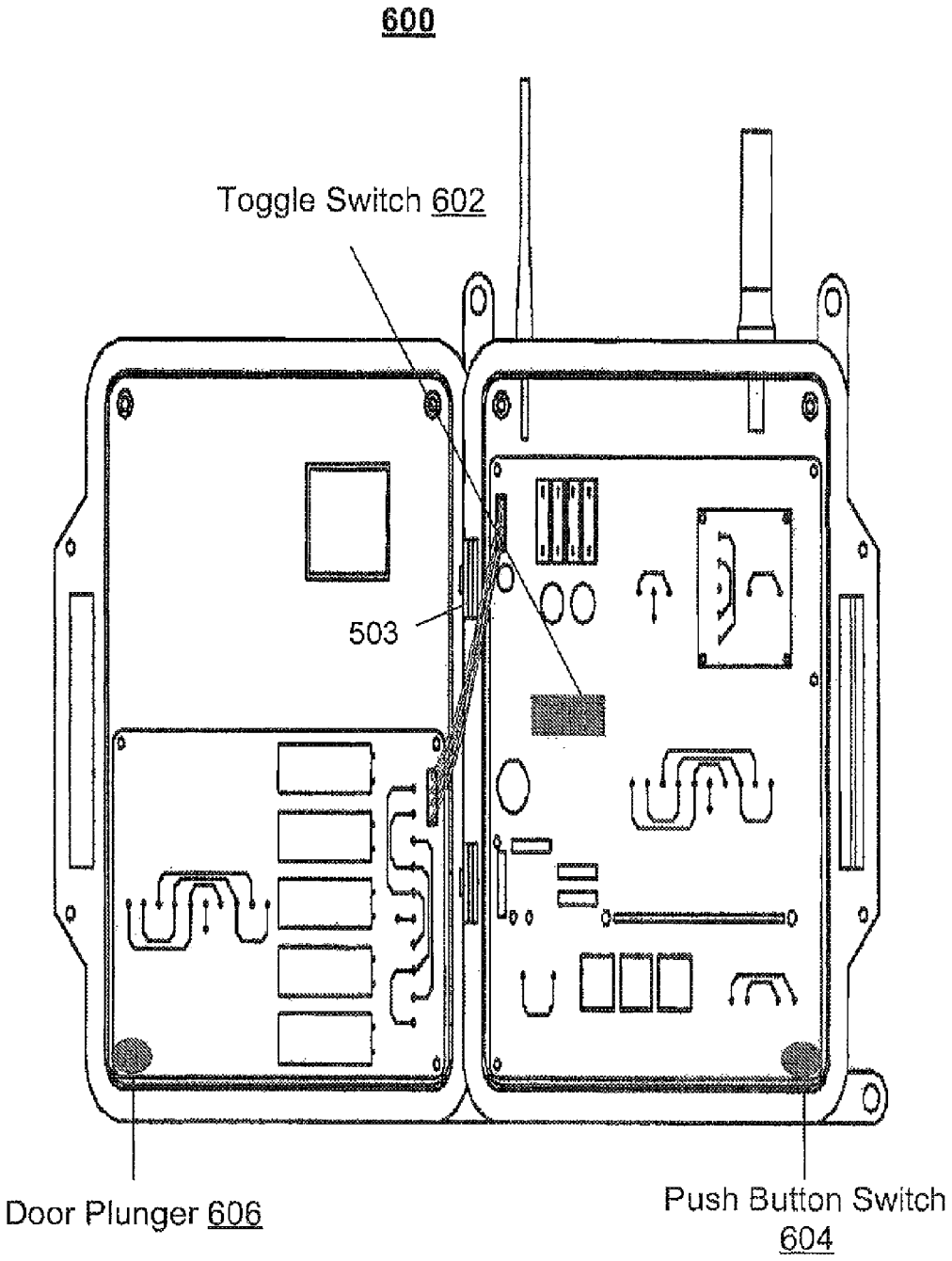
FIG. 6 illustrates a plurality of actuatable members in an embodiment of the present invention.

As shown in FIG. 6, the power supply circuit board may include actuatable members for activating/deactivating the power supply from one or more circuit boards. In one embodiment generally 600 of the present invention, an actuatable member may be a toggle switch 602. The toggle switch 602 is associated with the power supply circuitry for regulating power to one or more circuit boards. The power supply circuit may include an interrupt line, and the toggle switch 602 may be coupled to the interrupt line. When the toggle switch 602 is actuated by changing its position from ON state to OFF state, the interrupt line may isolate the regulated power supply pin of the voltage regulator, thereby isolating the power from one or more circuit boards.

During maintenance it may be desirable to isolate one or more circuit boards by disabling the power supply circuit board 502. In this aspect, an actuatable member may be provided on the power supply circuit board 502, for example a toggle switch 602 to facilitate the replacement of the specific board without shut down. In addition, hot-swapping one or more circuit boards allows the intelligent communication device 102 to perform other operations such as process management, memory management and other processes not directly linked with the isolated circuit board. For example, hot-swapping the communication circuit board 504 by isolating it from the power supply may result in suspension of the process associated with the communication circuit board 504. Alternatively, all of the processes associated with the communication circuit board 504 may be stored in memory in a passive state that allows it to execute the instructions/processes when activated.

In another embodiment, multiple actuatable members may be provided to activate or deactivate an electronic circuitry associated with the intelligent communications device 102. For example, the multiple actuatable members may include a toggle switch 602 to isolate the power supply and a push button switch 604 to raise an alarm in the event of a security breach. The push button switch 604 may raise an audible alert or send a signal to the central authority to report, for instance, removal of the detachable cover 506 by an unauthorized entity. In other embodiments, multiple actuatable members may include different type of switches, such as: a single on-off switch; a single pole; a single throw; a single pole, double throw; a single pole changeover; a double pole, single throw; a double pole, double throw; a push button switch; or a digital switch. In this embodiment, the toggle switch 602 may be utilized for isolating the power supply from one or more circuit boards. In addition, the push button switch 604 may implement a security mechanism for raising an alarm when the detachable cover 606 of the enclosure is removed by an unauthorized entity, such as a field worker. In another example, the actuatable member may be affixed to a power supply circuit board 502 having electronic circuitry to initiate an alarm in response to removing of the detachable cover 606 associated with the enclosure.

In an embodiment of the present invention, utility grade enclosure 508 may include one or more hinges 503 to allow the detachable cover 506 to be opened for performing maintenance. The detachable cover 506 may rotate along its longitudinal axis and may expose the plurality of circuit boards for maintenance. The push button switch 604 may be affixed on the utility grade enclosure 508 opposite to the hinged side. In a normal operating mode, the detachable cover 506 may mate with corresponding door plunger 606 thereby keeping the alarm circuitry in an open position.

The detachable cover 506 may be opened along a rotation axis, operative to allow the detachable cover 506 to swing into an open position. When the detachable cover 506 is opened, the plurality of circuit boards are exposed to an external environment. In this aspect, the push button switch 604 is activated, thereby initiating an alarm.

In embodiments of the present invention, the actuatable member may be a digital switch. The actuatable member may include a digital lock fabricated using integrated circuits. A digital lock may assess the position of the detachable cover 506 and accordingly raise an alarm. For example, a touch sensor may be pivoted on the detachable cover 506 and its handle, which may be associated with a motion sensor; any motion of the handle may be detected, which may initiate necessary action for isolating one or more circuit boards. In another example, a switch coupled to the power supply board may be utilized for detecting a security breach. The switch may be held in a closed position under normal circumstances by a plunger affixed to the detachable cover 506; and may be initiated when the detachable cover 506 is detached. An attempt to open the detachable cover 506 may result in activating the switch thereby activating an alarm. The alarm may indicate a security breach by an unauthorized entity.

In an embodiment of the present invention, the utility grade enclosure 508 may include a built-in switch. The utility grade enclosure 508 may be fabricated from plastic, metal, and/or other materials. The utility grade enclosure 508 may be explosion-proof or a hazardous location-rated enclosure. Such utility grade enclosures may be fabricated using metals such as steel or aluminum of sufficient thickness. In an embodiment of the present invention, the enclosure may be an ordinary enclosure for securing the plurality of circuit boards.

In yet another embodiment of the present invention, the intelligent communication device 102 may include a power failure module, to inform the central authority about the power failure for an unknown reason. In another embodiment, the intelligent communication device 102 may inform the utilities about the power failure. The power failure condition may initiate an alarm for alerting the central authority or other entities about power failure. In normal operation by switching off the power supply, the maintenance staff may unintentionally trigger the power off alarm. In such situation, isolating one or more circuit boards from the power supply circuit board 502 may facilitate maintenance in an efficient manner.

Figure 7A:
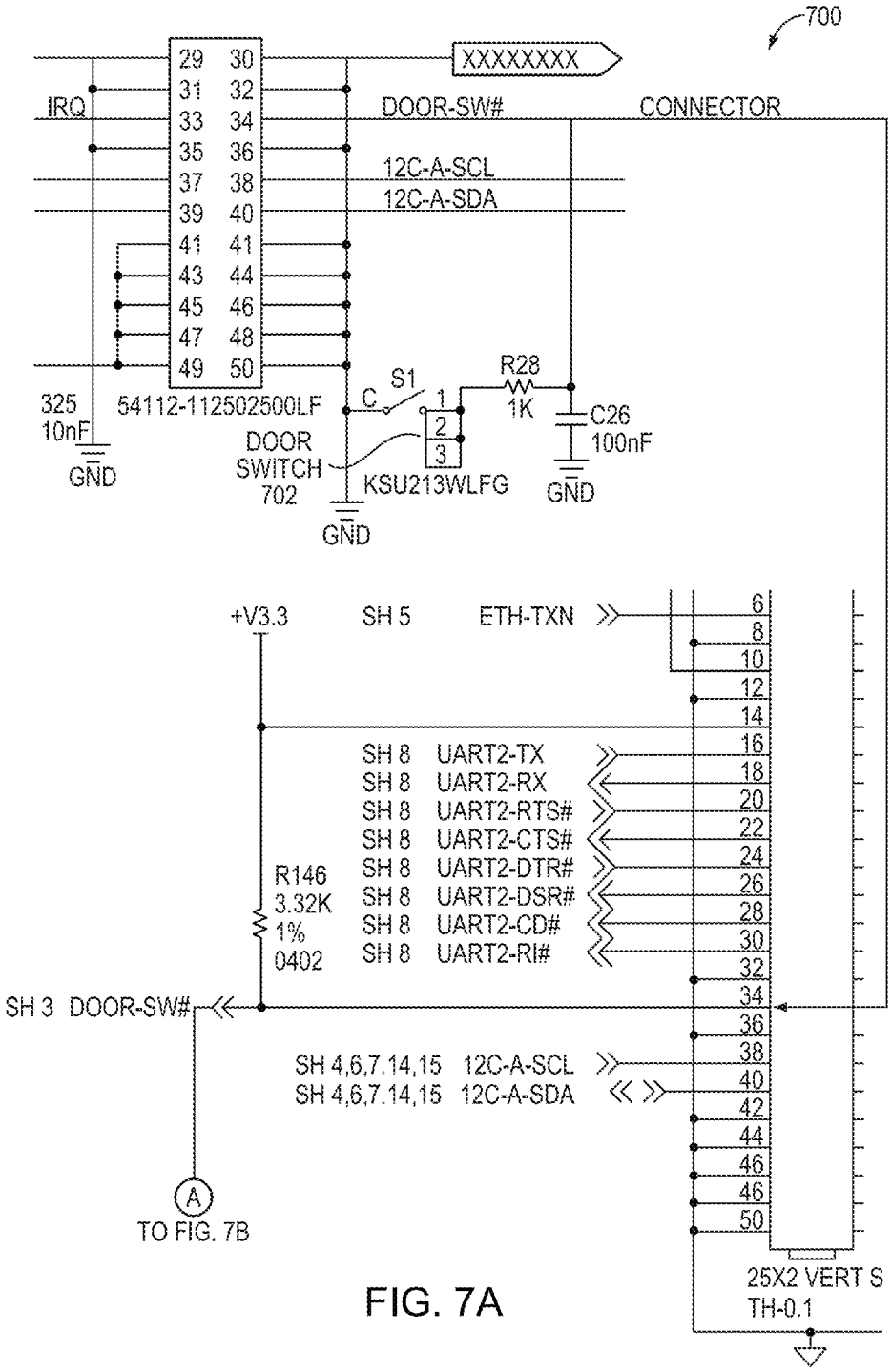
FIG. 7 (separated into component portions FIGS. 7A and 7B) illustrates an exemplary implementation of the door alarm actuatable member in an embodiment of the present invention.
Figure 7B:
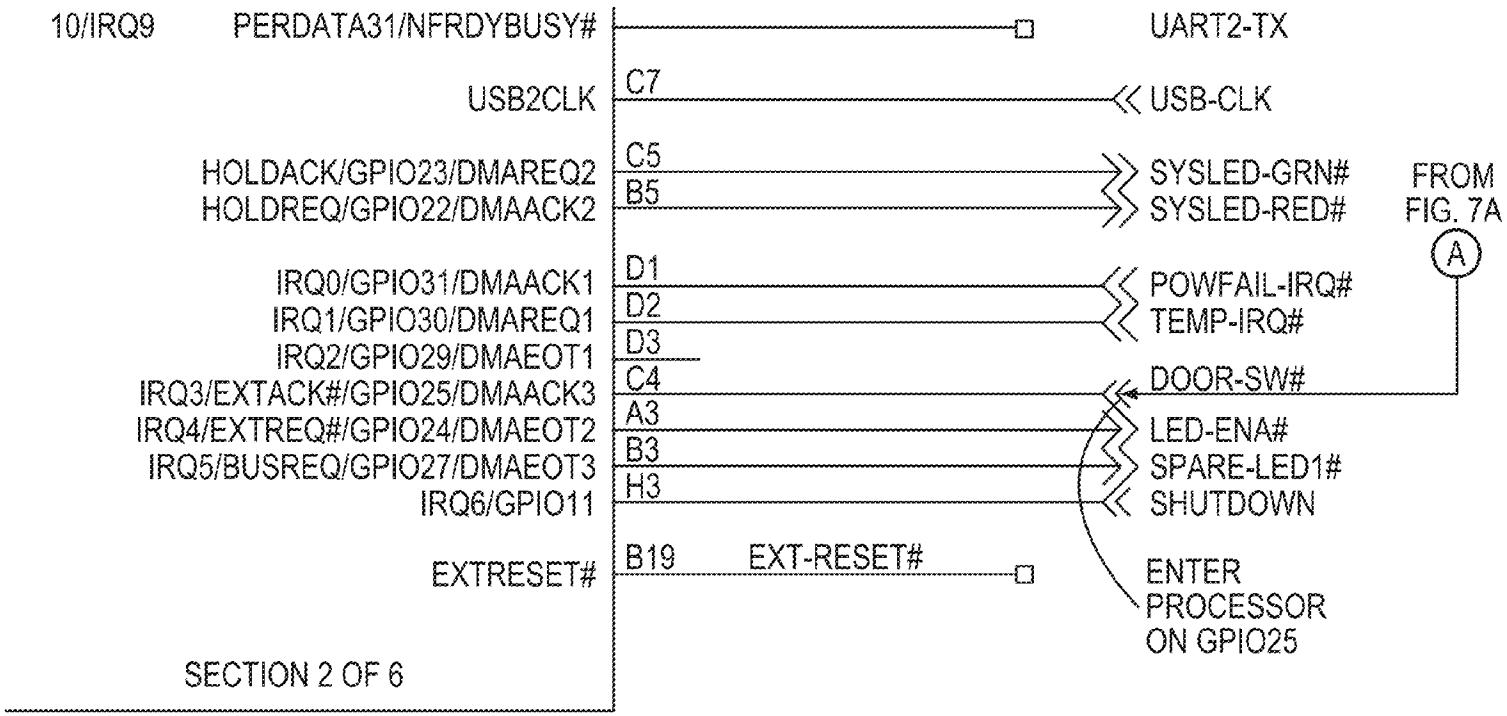

Referring to FIG. 7, a door alarm circuit generally 700 is operative to raise an alert when an unauthorized entity tries to break into the sealed enclosure. The door switch 702 may be activated and may send a message to other intelligent devices or the central authority to report a security breach.

Figure 8:
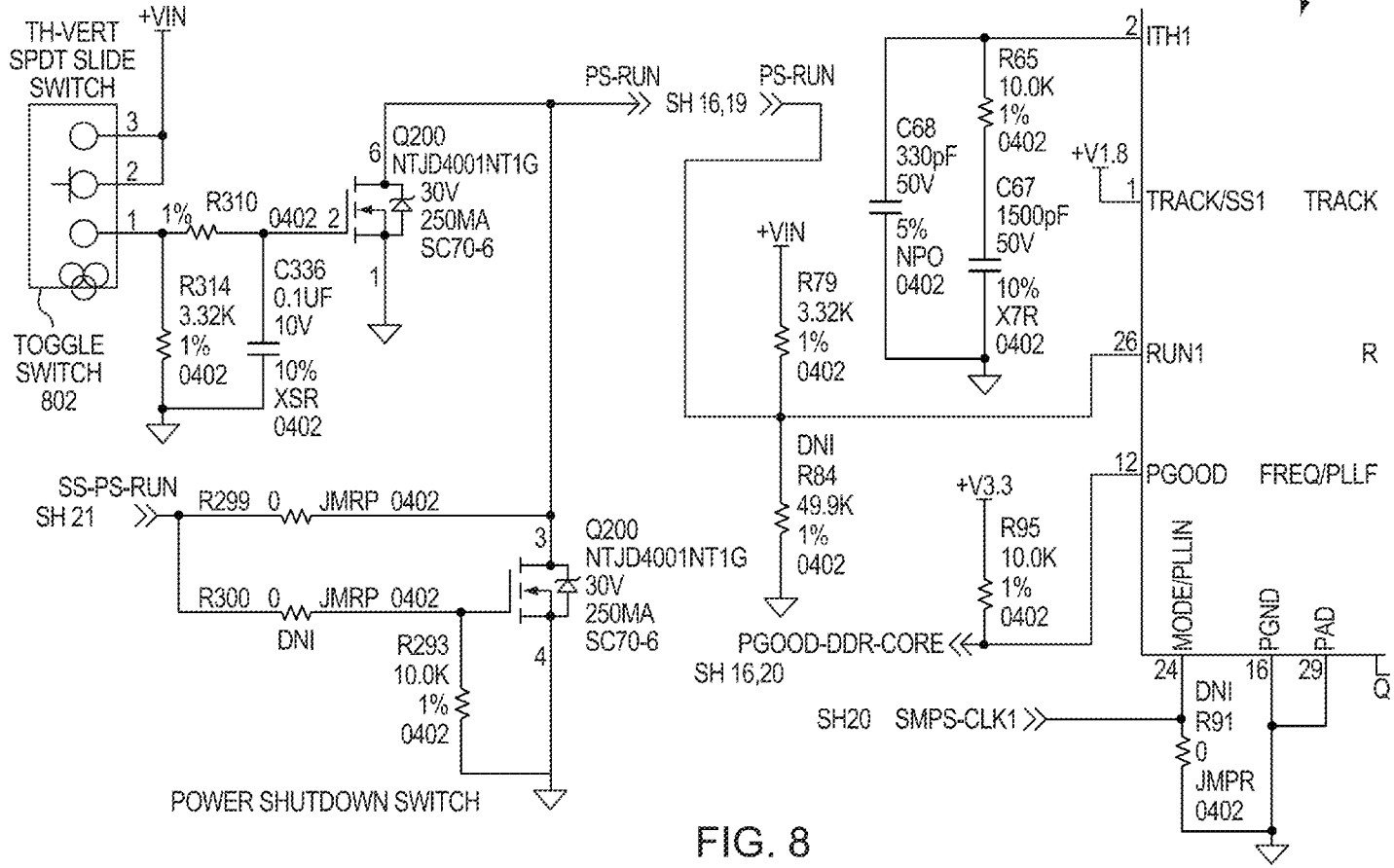
FIG. 8 depicts a circuitry along with a toggle switch embedded on the power supply circuit board in one embodiment of the present invention.

Referring to FIG. 8, a power isolation circuit along with a toggle switch embedded on the power supply circuit board is shown, according to one embodiment generally 800 of the present invention. The toggle switch 802 may be utilized to signal an interrupt to isolate at least one or more circuit boards from the power supply circuit board 502.

The power failure alarm may be different than the interrupt configured to sense breaking in of the enclosure cover. In an embodiment of the present invention, the detachable cover triggers an interrupt that may communicate to a central authority.

In an embodiment of the present invention, raising an interrupt may be considered as an authorized entry for performing maintenance work on the intelligent communication device 102. Thus, enabling or disabling the interrupt may indicate authorized actions and may not be conceived as a security breach.

In another embodiment of the present invention, an automatic switch may be provided that may be triggered to enable the interrupt through a remote interface. The remote interface may be actuated via remote for isolating one or more circuit boards.

In an embodiment of the present invention, the one or more circuit boards may be placed in an ordinary grade enclosure. The enclosure may be formed by a back wall with side walls. A detachable cover may be provided that may secure the one or more circuit boards inside the enclosure. The enclosure may provide protection to one or more circuit boards. In one embodiment, the detachable cover has actuatable means such as a switch affixed to it to raise an alert when the detachable enclosure is tampered with by an unauthorized entity.

The methods described herein may be deployed in part or in whole through one or more devices that are capable of executing computer software, program codes, and/or instructions on corresponding processors. A processor may be part of a server, client, network infrastructure, mobile computing platform, stationary computing platform, or other computing platform. The processor may be any kind of computational or processing device capable of executing program instructions, codes, and/or binary instructions. The processor may be or may include a signal processor, a digital processor, an embedded processor, a microprocessor or any variant such as a co-processor (e.g. a math co-processor, a graphic co-processor, and/or a communication co-processor), that may directly or indirectly facilitate execution of program code or program instructions stored thereon. In addition, the processor may enable execution of multiple programs, threads, and codes. The threads may be executed simultaneously to enhance the performance of the processor and to facilitate simultaneous operations of the application. By way of implementation, methods, program codes, program and instructions are described herein may be implemented in one or more threads. A thread may spawn other threads that may have assigned priorities associated with them; the processor may execute these threads based on a priority or any other order based on instructions provided in the program code. The processor may include memory that stores methods, codes, instructions, and programs as described herein and elsewhere. The processor may access a storage medium through an interface that may store methods, codes, and instructions as described herein and elsewhere. The storage medium associated with the processor for storing methods, programs, codes, program instructions or other types of instructions capable of being executed by the computing or processing device may include, but may not be limited to, one or more of a CD-ROM, DVD, memory, hard disk, flash drive, RAM, ROM, and/or cache.

The processor may include one or more cores that may enhance speed and performance of a multiprocessor. In embodiments, the process may be a dual core processor, quad core processors, or other chip-level multiprocessors that combine two or more processors.

The methods and systems described herein may transform physical and/or or intangible items from one state to another. The methods and systems described herein may also transform data representing physical and/or intangible items from one state to another.

The elements described and depicted herein, including the elements described in flow charts and block diagrams throughout the figures, imply logical boundaries between the elements. However, according to software or hardware engineering practices, the depicted elements and the functions thereof may be implemented on machines through computer executable media having a processor capable of executing program instructions stored thereon as a monolithic software structure, as standalone software modules, or as modules that employ external routines, code, services, and so forth, or any combination of these, and all such implementations may be within the scope of the present disclosure. Examples of such machines may include, but may not be limited to, personal digital assistants, laptops, personal computers, mobile phones, other handheld computing devices, medical equipment, wired or wireless communication devices, transducers, chips, calculators, satellites, tablet PCs, electronic books, gadgets, electronic devices, devices having artificial intelligence, computing devices, networking equipments, servers, and/or routers. Furthermore, the elements depicted in the flow chart and block diagrams or any other logical component may be implemented on a machine capable of executing program instructions. Thus, while the foregoing drawings and descriptions set forth functional aspects of the disclosed systems, no particular arrangement of software for implementing these functional aspects should be inferred from these descriptions unless explicitly stated or otherwise clear from the context. Similarly, it will be appreciated that the various steps identified and described above may be varied, and that the order of steps may be adapted to particular applications of the techniques disclosed herein. All such variations and modifications are intended to fall within the scope of this disclosure. As such, the depiction and/or description of an order for various steps should not be understood to require a particular order of execution for those steps, unless required by a particular application, or explicitly stated or otherwise clear from the context.

The methods and/or processes described above, and steps thereof, may be realized in hardware, software or any combination of hardware and software suitable for a particular application. The hardware may include a general purpose computer and/or dedicated computing device or specific computing device or particular aspect or component of a specific computing device. The processes may be realized in one or more microprocessors, microcontrollers, embedded microcontrollers, programmable digital signal processors or other programmable device, along with internal and/or external memory. The processes may also, or instead, be embodied in an application-specific integrated circuit, a programmable gate array, programmable array logic, or any other device or combination of devices that may be configured to process electronic signals. It will further be appreciated that one or more of the processes may be realized as a computer executable code capable of being executed on a machine-readable medium.

The computer executable code may be created using a structured programming language such as C, an object oriented programming language such as C++, or any other high-level or low-level programming language (including assembly languages, hardware description languages, and database programming languages and technologies) that may be stored, compiled or interpreted to run on one of the above devices, as well as heterogeneous combinations of processors, processor architectures, or combinations of different hardware and software, or any other machine capable of executing program instructions.

Thus, in one aspect, each method described above and combinations thereof may be embodied in computer executable code that, when executing on one or more computing devices, performs steps thereof. In another aspect, the methods may be embodied in systems that perform steps thereof, and may be distributed across devices in a number of ways, or all of the functionality may be integrated into a dedicated, standalone device or other hardware. In another aspect, the means for performing steps associated with the processes described above may include any of the hardware and/or software described above. All such permutations and combinations are intended to fall within the scope of the present disclosure.

While the invention has been disclosed in connection with the preferred embodiments shown and described in detail, various modifications and improvements thereon will become readily apparent to those skilled in the art. Accordingly, the spirit and scope of the present invention is not to be limited by the foregoing examples.

What is claimed is:

1. A plurality of actuatable members for selectively detecting a security breach and for activating/deactivating at least one of a plurality of circuit boards of an intelligent communication device, wherein the plurality of circuit boards are operative to perform communication functions in a network, and the intelligent communication device includes power supply circuitry, the plurality of actuatable members comprising:

a toggle switch operative to, when actuated, disable the power supplied to at least one of the plurality of circuit boards while at least one other of the plurality of circuit boards retains power and is fully operative to perform at least one of the communication functions; and a pushbutton switch affixed to a utility-grade enclosure housing the plurality of circuit boards and having a detachable cover with associated circuitry for initiating an alarm on detection of a security breach, when the detachable cover is opened without authority.

2. The actuatable members of claim 1, wherein the plurality of circuit boards are mounted within the utility-grade enclosure comprising a housing with a back wall and a plurality of side walls defining an enclosed space for receiving the plurality of circuit boards, and the detachable cover is operative to cover and seal the housing and the plurality of circuit boards enclosed within the housing.

3. The actuatable members of claim 2, wherein the pushbutton switch is operative to be actuated in response to detachment of the detachable cover.

4. The actuatable members of claim 2, wherein the pushbutton switch is operatively coupled to at least a portion of the detachable cover and at least an internal portion of the housing defined by the back wall and plurality of side walls.

5. The actuatable members of claim 2, wherein the housing further comprises a hinge operative to allow the detachable cover to swing open from a sealed position to an open position in which the plurality of circuit boards are exposed to an external environment, along a rotation axis, and further operative to allow the detachable cover to swing closed from the open position to the sealed position along the rotation axis, and wherein the pushbutton switch is operatively coupled such as to be actuated when the detachable cover is caused to swing open.

6. The actuatable members of claim 1, wherein when the toggle switch is actuated, the at least one of the plurality of circuit boards to which the power supplied is disabled is operatively coupled to the at least one other of the plurality of circuit boards that retains power.

7. The actuatable members of claim 1, wherein the power supply circuitry comprises voltage regulation circuitry operatively coupled to a corresponding interrupt line, and operative to selectively provide power to the plurality of circuit boards such that when the toggle switch is activated, the voltage regulation circuitry is interrupted such that power is not provided to the at least one of the plurality of circuit boards to which the power supplied is disabled.

8. The actuatable members of claim 1, wherein the power supply circuitry is operative to deliver power to the circuit boards except the at least one of the plurality of circuit boards to which the power supplied is disabled.

9. The actuatable members of claim 1, wherein the at least one other of the plurality of circuit boards that retains power is isolated from the power supply circuitry when the toggle switch is actuated to a deactivated state, and the associated circuitry for initiating an alarm comprises circuitry that is operative to send a message to at least one other intelligent communication device in the network to indicate that the disablement of the at least one of the plurality of circuit boards is authorized.

10. The actuatable members of claim 9, wherein the network comprises a smart grid.

11. A method for detecting a security breach and selectively deactivating at least one of a plurality of circuit boards of an intelligent communication device, the plurality of circuit boards operative to perform communication functions in a network, the method comprising:

providing a plurality of actuatable members comprising a toggle switch and a pushbutton switch;

configuring at least one of the plurality of circuit boards other than the at least one circuit board that is deactivated to retain power and remain fully operative to perform at least one of the communication functions when the toggle switch is actuated to deactivate the at least one of the plurality of circuit boards; and detecting an unauthorized attempt to open a detachable cover resulting in actuation of the pushbutton switch, the pushbutton switch held in a closed position when the detachable cover is securely affixed to a utility-grade enclosure.

12. The method of claim 11, wherein the plurality of circuit boards are mounted within the utility-grade enclosure comprising a housing with a back wall and a plurality of side walls defining an enclosed space for receiving the plurality of circuit boards, and the detachable cover is operative to cover and seal the housing and the plurality of circuit boards enclosed within the housing.

13. The method of claim 12, wherein the pushbutton switch is operatively coupled to at least a portion of the detachable cover and at least an internal portion of the housing defined by the back wall and plurality of side walls.

14. The method of claim 12, wherein the housing further comprises a hinge operative to allow the detachable cover to swing open from a sealed position to an open position in which the plurality of circuit boards are exposed to an external environment, along a rotation axis, and further operative to allow the detachable cover to swing closed from the open position to the sealed position along the rotation axis, and wherein the pushbutton switch is operatively coupled such as to be actuated when the detachable cover is caused to swing open.

15. The method of claim 11, wherein the pushbutton switch is operative to be actuated in response to detachment of the detachable cover.

16. The method of claim 11, wherein when the toggle switch is actuated, the at least one circuit board that is deactivated is operatively coupled to the at least one of the plurality of circuit boards that retains power.

17. The method of claim 11, further including power supply circuitry comprising voltage regulation circuitry operatively coupled to a corresponding interrupt line, and operative to selectively provide power to the plurality of circuit boards such that when the toggle switch is activated, the voltage regulation circuitry is interrupted such that power is not provided to the at least one circuit board that is deactivated.

18. The method of claim 11, further including power supply circuitry operative to deliver power to the circuit boards except the at least one circuit board that is deactivated.

19. The method of claim 11, wherein the at least one of the plurality of circuit boards other than the at least one circuit board that is deactivated is isolated from power when the toggle switch is actuated to a deactivated state, and the method further includes sending a message to at least one other intelligent communication device in the network to indicate that the disablement of the at least one of the plurality of circuit boards is authorized.

20. The method of claim 11, wherein the network comprises a smart grid.

21. An intelligent communication device, comprising:

a plurality of circuit boards that are operative to perform communication functions in a network, comprising a first circuit board and a second circuit board;

a first actuatable member operative to selectively activate circuitry on the second circuit board, comprising a toggle switch operative to, when actuated, disable power supplied to the second circuit board while the first circuit board retains power and is fully operative to perform at least one of the communication functions; and a second actuatable member operatively coupled to an enclosure and a detachable cover, the detachable cover configured to raise an alert when the detachable cover is opened without authority.

22. The intelligent communication device of claim 21, wherein the first circuit board and the second circuit board are mounted within the enclosure comprising a housing with a back wall and a plurality of side walls defining an enclosed space for receiving the first circuit board and second circuit board and having a detachable cover operative to cover and seal the housing and the first circuit board and second circuit board enclosed within the housing.

23. The intelligent communication device of claim 22, wherein the first actuatable member comprises a toggle switch that is operative to be actuated in response to detachment of the detachable cover.

24. The intelligent communication device of claim 23, wherein the toggle switch is operatively coupled to at least a portion of the detachable cover and at least an internal portion of the housing defined by the back wall and plurality of side walls.

25. The intelligent communication device of claim 24, wherein the housing further comprises a hinge that is operative to allow the detachable cover to swing open from a sealed position to an open position in which the first circuit board and the second circuit board are exposed to an external environment, along a rotation axis, and further operative to allow the detachable cover to swing closed from the open position to the sealed position along the rotation axis, and wherein the toggle switch is operatively coupled such as to be actuated when the detachable cover is caused to swing open.

26. The intelligent communication device of claim 25, further including voltage regulation circuitry that is operatively coupled to a corresponding interrupt line, and operative to selectively provide power to the respective first circuit board and second circuit board, such that when the toggle switch is activated, the voltage regulation circuitry is interrupted and power is not provided to the second circuit board.

27. The intelligent communication device of claim 25, wherein the first circuit board comprises circuitry operative to, when the first actuatable member is actuated, send a message to at least one other intelligent communication device in the network to indicate that the disablement of the second circuit board is authorized.

28. The intelligent communication device of claim 27, wherein the at least one other communication device in the network operates at a central utility.

29. The intelligent communication device of claim 28, wherein the network comprises a smart grid.

* * * * *

UNITED STATES PATENT AND TRADEMARK OFFICE

CERTIFICATE OF CORRECTION

PATENT NO. : 8,587,429 B2
APPLICATION NO. : 12/899480
DATED : November 19, 2013
INVENTOR(S) : Melvin et al.

It is certified that error appears in the above-identified patent and that said Letters Patent is hereby corrected as shown below:

In the Specification

Column 3, line 12 (paragraph 21) "residential entities 108 c," should be removed.

Column 3, line 26 (paragraph 22) "such as industry" should be removed.

Signed and Sealed this
Twenty-fifth Day of February, 2014

Michelle K. Lee

Michelle K. Lee
*Deputy Director of the United States Patent and Trademark Office*